US005685456A

United States Patent [19]

Goldstein

[11] Patent Number: 5,685,456

[45] Date of Patent: Nov. 11, 1997

[54] REGULATED DISPENSING SYSTEM

[75] Inventor: David Goldstein, Potomac, Md.

[73] Assignee: The United States of America as represented by the Secretary of the Navy, Washington, D.C.

[21] Appl. No.: 449,162

[22] Filed: May 24, 1995

[51] Int. Cl.[6] ..... B65D 35/28

[52] U.S. Cl. ..... 222/95; 222/340

[58] Field of Search ..... 222/95, 340

[56] References Cited

U.S. PATENT DOCUMENTS

| | | | |
|---|---|---|---|
| 3,734,348 | 5/1973 | White | 222/1 |
| 3,951,310 | 4/1976 | Steiman | 222/95 |
| 4,136,802 | 1/1979 | Mascia et al. | 222/95 |
| 4,193,513 | 3/1980 | Bull, Jr. | 222/340 X |
| 4,899,910 | 2/1990 | Tabei et al. | 222/54 |
| 5,139,168 | 8/1992 | Gueret | 222/92 |
| 5,240,152 | 8/1993 | Scholz | 222/336 |

*Primary Examiner*—Gregory L. Huson

*Attorney, Agent, or Firm*—John Forrest; Jacob Shuster

[57] ABSTRACT

A coil spring made of a shape memory alloy is seated within the container of a portable dispenser in a contracted condition under compressive stress maintained by the physical constraint of a pressure plate engaging a collapsible enclosure internally lining the dispenser container to isolate therein material to be dispensed. The pseudoelastic properties of the shape memory alloy are selected to exclusively regulate the storage and delivery pressures in order to accommodate different materials to be dispensed and control discharge thereof by the dispenser.

9 Claims, 2 Drawing Sheets

REGULATED DISPENSING SYSTEM

BACKGROUND OF THE INVENTION

The present invention relates in general to the dispensing of materials from a container, regulated by a shape memory alloy structure according to teachings extracted from prior copending application Ser. No. 08/317,451 filed Oct. 4, 1994 and in U.S. Pat. No. 5,408,932 to Hesse et al. issued Apr. 25, 1995, the disclosures of which are incorporated herein by reference.

The dispensing of pressurized fluent-like materials in the form of gases, liquids and particulate solids from a portable spray canister, is generally well known in the art. Because of the dangers associated with use of fluorocarbons as a pressurizing medium in such spray dispensers, pump dispensing systems have been introduced which often involve the admixture of air and moisture with the material being dispensed. Portable dispensers having collapsible storage bags within which the material to be dispensed is isolated, are also known as disclosed for example in U.S. Pat. Nos. 5,139,168 and 5,240,152 to Gueret and Scholz, respectively. According to the Gueret patent, the storage bag is a flexible liner within an outer rigid container into which a discharge tube projects from a manually operable spray head. The storage bag according to the Scholz patent is of a flexible bellows type within which a liquid is isolated for pressurization by a piston and elastically deformable foam that is mechanically compressed through a manually controlled device.

In regard to prior art use of a shape memory alloy structure within a dispenser, U.S. Pat. No. 4,899,910 to Tabel et al. is of interest. According to the Tabel et al. patent, sealant material is pressurized under the bias of a shape memory coil spring exerted on a piston in response to heating of the coil spring in order to effect sealant discharge from the dispenser through an outlet nozzle. Thus, use of a shape memory type of pressurized coil spring in a dispenser was heretofore restrictively associated with the introduction of heat energy from a heating unit as in the case of a shape memory alloy structure used for pressurized discharge of liquid, also disclosed in U.S. Pat. No. 3,734,348 to White. According to the Whim patent, the shape memory alloy in the form of "Nitinol" is used as the material from which a flexible bellows type of storage bag is made.

It is therefore an important object of the present invention to provide a portable dispenser within which material may be stored under pressure of a spring bias and dispensed therefrom under selective control, without use of energy generating devices involving pressurizing media, pumps or heating units.

Additional objects of the present invention include the provision of a more economical and portable dispenser for a wide variety of materials adapted to be completely discharged without contamination.

SUMMARY OF THE INVENTION

In accordance with the present invention, material to be dispensed is isolated within a collapsible enclosure internally lining the container of a portable dispenser. The collapsible enclosure is engaged by a pressure plate through which the material is maintained under a storage pressure prior to dispensing thereof. The pressure plate is displaceable during the dispensing of the material from the container to regulate and obtain complete material discharge from the collapsible enclosure under a constant delivery pressure.

Regulation of both the storage pressure and the constant delivery pressure is effected exclusively by use of pseudoelastic properties of a coil spring that is maintained deformed under stress prior to dispensing operation by physical constraint in a contracted condition seated in the dispenser container. The constant delivery pressure is obtained during pseudoelastic shape recovery expansion of the coil spring upon release of the physical constraint which is established through the pressure plate disposed between the coil spring and the collapsible enclosure. The pseudoelastic properties of the shape memory alloy, from which the coil spring is made, are selected for the purposes of the present invention to provide the desired storage and delivery pressures accommodating the material to be dispensed and to assure complete regulated discharge thereof for safe disposal of the dispenser.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENTS

Figure 1:
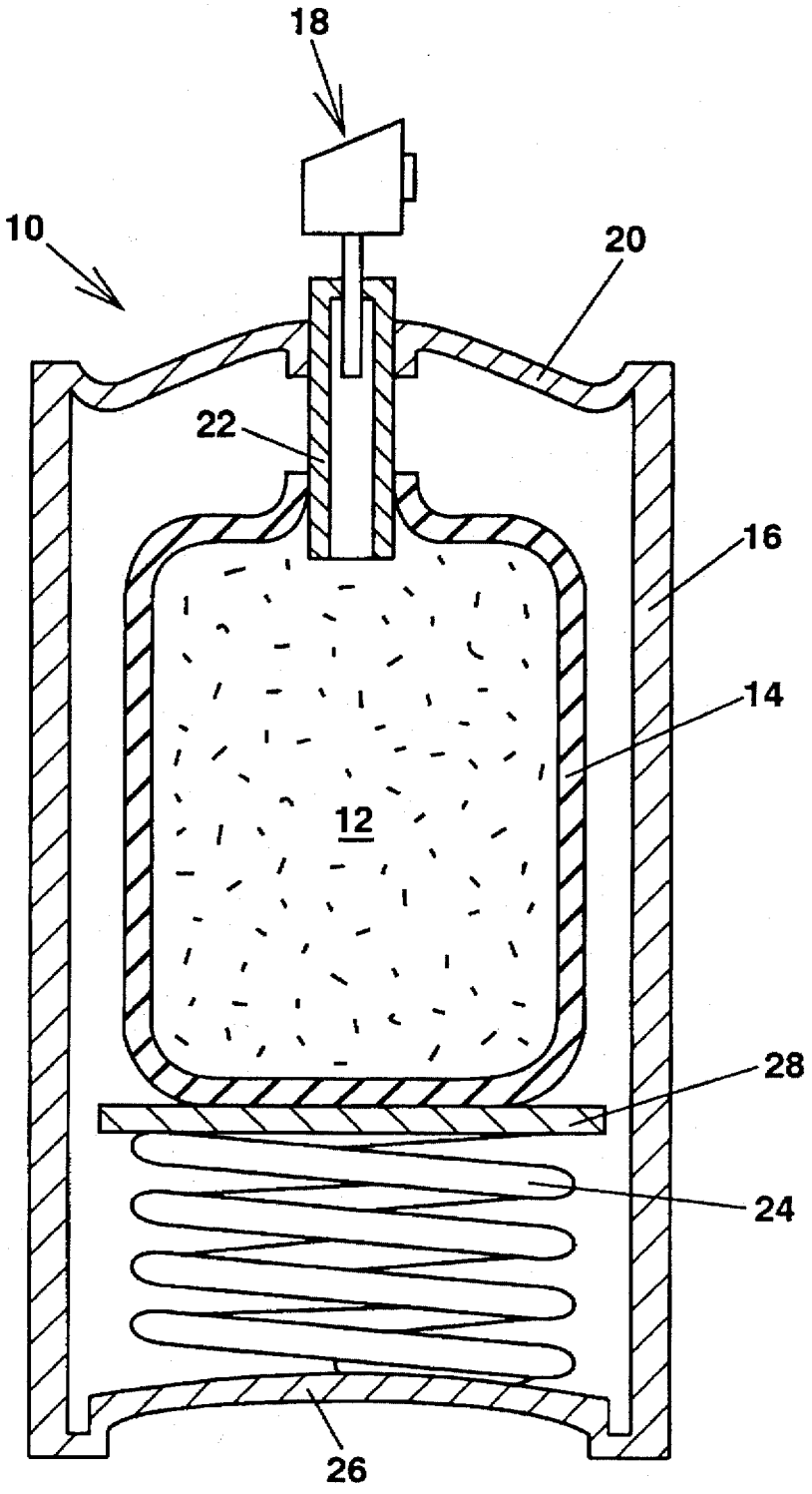
FIG. 1 is a side section view through a portable spray head dispenser, constructed in accordance with one embodiment of the invention.

Referring now to the drawing in detail, FIG. 1 illustrates a portable spray dispenser, generally referred to by reference numeral 10, constructed in accordance with the present invention. In such illustrated embodiment, a body of liquid, gas or particulate solids as the material 12 to be dispensed under pressure, is stored within a reservoir chamber enclosed by a collapsible enclosure 14 formed by a flexible plastic sheet liner inside of an outer rigid metal container 16. A conventional type of spray head 18 is associated with the dispenser 10 as shown in FIG. 1. The spray head 18 is thus located above the top closure end 20 of the container by mounting thereof on the upper external end of a rigid outlet tube 22 connected to the enclosure 14 and projecting into its reservoir chamber. Accordingly, when the spray head 18 is selectively actuated, the material 12 isolated within the reservoir chamber of enclosure 14 under a predetermined storage pressure will flow through tube 22 and be ejected to atmosphere by the spray head 18.

In accordance with the present invention, the enclosure 14 is completely collapsed in response to total discharge of material 12 by actuation of the spray head 18. Such discharge of material 12 is performed under a substantially constant delivery pressure either equal to or lower than that of the storage pressure. Toward that end, a shape memory component 24 acting as a superelastic helical spring is seated on the bottom end 26 of the container 16 and retained thereon under compresslye stress in a contracted condition by the physical constraint of pressure plate 28 engaging the bottom of the material filled enclosure 14 as shown in FIG. 1. The material content of enclosure 14 is thereby maintained under the storage pressure until a dispensing action is initiated by manual actuation of the spray head 18 to effect a reduction in pressure of the material being dispensed. The coil spring component 24 will expand axially from its contracted condition as it displaces the pressure plate 28 to dispense the material 12 under a constant delivery pressure.

The shape memory coil spring component 24 is made of a nickel/titanium alloy (Nitinol) having a superelastic or pseudoelastic shape recovery property as disclosed in U.S. Pat. No. 5,408,932, aforementioned. The coil spring component 24 furthermore has a desired contraction/expansion ratio selected from a range of available ratios in order to accommodate the material to be dispensed. An increased range of available ratios for the component 24 is made possible by its shape memory alloy composition and fabrication in accordance with the thermo-mechanical processing method disclosed in prior copending application Ser. No. 08/317,451 aforementioned, in order to accommodate a wide variety of materials to be dispensed. Conditioning of the coil spring component 24 by such thermo-mechanical processing method and establishment of its contracted condition under physical constraint through pressure plate 28 is performed before operational use of the dispenser 10. Axial expansion of the coil spring component 24 from its contracted condition shown in FIG. 1 during operational use of the dispenser, is effected solely in response to actuation of the spray head 18 without any other input. Such axial expansion of the coil spring component 24 is a function of dimensional factors such as rod wire size, coil diameter and number of coil turns, as well as shape memory alloy composition and the thermo-mechanical fabrication process.

Figure 2:
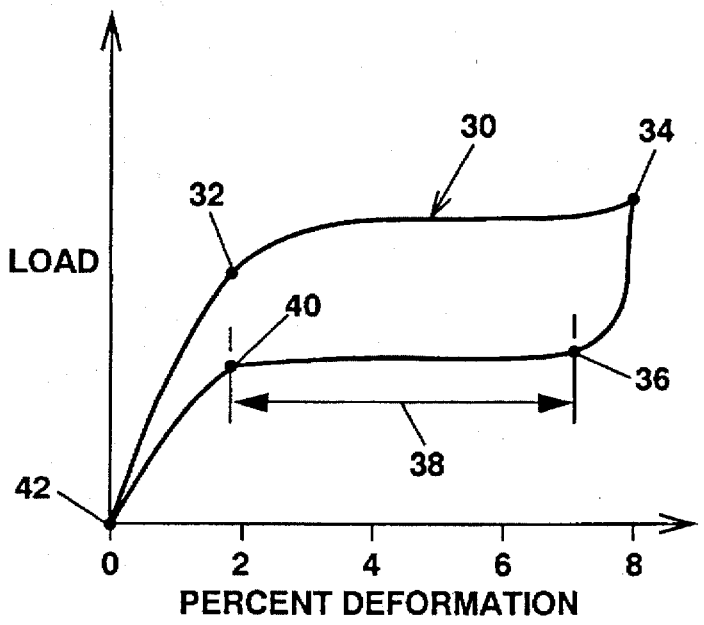
FIG. 2 is a graphical representation of pseudoelastic properties associated with the shape memory coil spring utilized in the dispenser shown in FIG. 1.

Proper selection of all factors for use of the coil spring component 24 as aforementioned, results in the establishment of pseudoelastic properties thereof as graphically exhibited in FIG. 2. Deformation of the component 24 to its contracted condition shown in FIG. 1, causes it to undergo loading as reflected by the upper portion of curve 30, between points 42 and 34. The desired pseudoelastic properties for the component 24 in accordance with the present invention is achieved by such loading along curve 30 beyond point 32 thereon. The storage pressure for the body of material 12 within enclosure 14 is thereby established by the component 24 in its contracted condition maintained under stress by physical constraint to store shape recovery energy. Upon release of the material 12 so pressurized by actuation of the spray head 18, the stress lead on the coil spring component 24, corresponding to point 34 on curve 30 in FIG. 2, is abruptly reduced to point 36 on the curve as the coil spring component begins to expand. The material 12 is then dispensed by continued expansion of the coil spring component 24 and regulated displacement of pressure plate 28, as reflected by the substantially constant unloading portion 38 of curve 30 between points 36 and 40. Thus, the portion 38 of curve 30 corresponds to the substantially constant delivery pressure exerted by coil spring component 24 through pressure plate 28 on the material 12 during the dispensing thereof, because of the unique selection and relationship of shape memory properties associated with the coil spring component 24 in the environment of the present invention. Upon full shape recovery of component 24, as reflected by point 42 on curve 30 of FIG. 2, the material 12 is totally dispensed and the enclosure 14 is fully collapsed.

In view of the foregoing described features of the present invention, the outer metal container 16 need not be pressure tight while the described dispensing action is performed by coil spring component 24 in air within a temperature range of −20° C. to +40° C. The reservoir chamber enclosed by the collapsible enclosure 14 will be anaerobic and therefore suitable for dispensing of liquids to infant children without air borne or moisture carried contamination. Other types of materials may also be dispensed, including gases and particulate solids such as perfumes, paints, solvents, cleaning materials, insecticides, and caulkings. In view of the total discharge of all material 12 by complete collapse of enclosure 14, problems of hazardous waste disposal of partially emptied spray dispensers is avoided.

Figure 3:
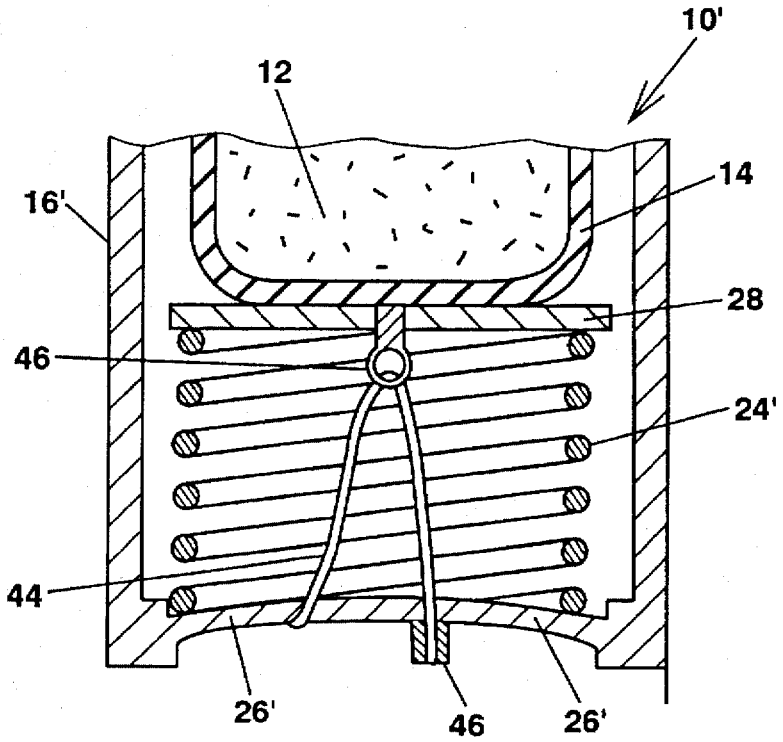
FIG. 3 is a partial side section view of a modified form of dispenser in accordance with another embodiment of the invention.

Conditioning and positioning of the coil spring component 24 within the dispenser 10 as hereinbefore described, involves its compressive contraction before placement and retention under constraint within the outer container 16. Alternatively, a comparable shape memory alloy coil spring component 24' may be placed in an outer dispenser container 16' as shown in FIG. 3. Prior to compressive deformation, the coil spring component 24' was conditioned by thermo-mechanical processing before seating thereof within the container 16'. The spring component 24' when so conditioned is retained seated in its compressively deformed condition engaging pressure plate 28' before the dispenser is used. Toward that end, physical constraint is provided by a holding cord 44 anchored at one end to the bottom 26' of the container 16' and looped through an eye bolt 46 projecting from the pressure plate 28'. The other end of cord 44 is connected to a removable button 46 in external abutment with the bottom 26' of the outer container as shown in FIG. 3. Accordingly, the pressure plate 28' may be selectively released for displacement during subsequent dispenser use by cutting or removed of the button 46. A dispensing action then ensures as hereinbefore described with respect to FIGS. 1 and 2.

Obviously, other modifications and variations of the present invention may be possible in light of the foregoing teachings. It is therefore to be understood that within the scope of the appended claims the invention may be practiced otherwise than as specifically described.

What is claimed is:

1. In a dispenser having a container within which a body of material is stored; retainer means for maintaining the body of material within the container; and selectively actuated means for releasing the retainer means to permit displacement thereof causing discharge of the body of material from the container under a delivery pressure, the improvement residing in: shape-memory means for imparting said displacement to the retainer means, said shape-memory means having pseudoelastic properties preselected to exclusively regulate said delivery pressure during said displacement of the retainer means causing said discharge of the body of material.

2. In combination with a container from which selective dispensing of material occurs under a delivery pressure, the improvement residing in: a shape-memory component having preselected pseudoelastic properties; and means releasably retaining the shape-memory component within the container in an energy storing condition for subsequent exclusive regulation of said delivery pressure in accordance with said preselected pseudoelastic properties during the selective dispensing of the material.

3. The improvement as defined in claim 2 wherein said shape-memory component is a coil spring endowed with said pseudoelastic properties to effect the regulation of said delivery pressure under a substantially constant valve.

4. The improvement as defined in claim 3 wherein said means releasably retaining the shape-memory component includes a displaceable pressure plate in engagement with the coil spring.

5. The improvement as defined in claim 4, further including a collapsible enclosure within the container within which the material is isolated under a storage pressure during engagement of the enclosure with the pressure plate to retain the shape-memory component in said energy storing condition under stress.

6. In combination with a container from which selective dispensing of material occurs, the improvement residing in: a coil spring endowed with pseudoelastic properties selected for exclusive regulation of said dispensing of the material under a substantially constant delivery pressure; a displaceable pressure plate in engagement with the coil spring; and releasable fastener means anchored to the container and connected to the pressure plate for holding thereof in engagement with the coil spring while in an energy storing condition under stress to subsequently effect said regulation of the selective dispensing of the material.

7. A portable dispenser, comprising: a container; a pressure plate positioned within the container to define a chamber therein from which ejection of material occurs; coil spring means made of a shape-memory alloy for storing shape-recovery energy biasing said pressure plate; and collapsible means for isolating the material in the chamber under a storage pressure established through the pressure plate by the coil spring means prior to said ejection of the material; the shape memory alloy having selected pseudoelastic properties exclusively establishing a delivery pressure exerted through said pressure plate and the collapsible means on the material during said ejection thereof.

8. A dispenser comprising: a container having a discharge outlet through which selectively controlled discharge of material occurs; a flexible enclosure within which the material is stored in communication with the discharge outlet; a pressure plate disposed in the container in engagement with the flexible enclosure; and means for pressurization of the material stored in the flexible enclosure and regulation of said discharge thereof by displacement of the pressure plate, consisting of: a coil spring in engagement with the pressure plate and positioned within the container in a contracted condition; said coil spring being made of a shape memory alloy having selected pseudoelastic properties exclusively controlling said pressurization of the stored material and the regulation of said discharge thereof in response to shape-recovery expansion of the coil spring from said contracted condition thereof.

9. A method of utilizing a component made of a shape memory alloy to control dispensing of material under a delivery pressure, including the steps of: selecting the shape memory alloy of the component to exclusively regulate said delivery pressure; packaging the component under stress; retaining said component packaged under stress; and selectively reducing said stress from the packaged component for subsequent use thereof by shape recovery extension to substantially maintain the delivery pressure constant while the material is being dispensed.

* * * * *